US006155249A

United States Patent [19]

Gregory

[11] Patent Number: 6,155,249

[45] Date of Patent: Dec. 5, 2000

[54] GAS LOG SET

[76] Inventor: Willis H. Gregory, 3581 Benson Rd., Angier, N.C. 27501

[21] Appl. No.: 09/303,404

[22] Filed: May 3, 1999

[51] Int. Cl.[7] ..... F23C 1/18

[52] U.S. Cl. ..... 126/512; 126/152 A; 126/152 B; 126/540; 431/125

[58] Field of Search ..... 126/512, 92 R, 126/92 AC, 91 R, 85 R, 298, 152 A, 152 B, 540, 541, 542, 593, 243; 431/125, 126

[56] References Cited

U.S. PATENT DOCUMENTS

| | | | |
|---|---|---|---|
| D. 308,248 | 5/1990 | Koch | D23/401 |
| 483,410 | 9/1892 | Watts | 126/541 |
| 1,176,233 | 3/1916 | Mead | 126/540 |
| 3,385,651 | 5/1968 | Rasmussen et al. | 126/512 |
| 3,582,250 | 6/1971 | Chatfield | 431/125 |
| 4,110,063 | 8/1978 | Mitchell | 431/125 |
| 4,180,054 | 12/1979 | Romero et al. | 126/540 |
| 4,602,609 | 7/1986 | Wright | 126/92 AC |
| 4,883,043 | 11/1989 | Thow et al. | 126/512 |
| 4,890,601 | 1/1990 | Potter | 126/512 |
| 4,940,407 | 7/1990 | Rehberg et al. | 126/512 |
| 4,976,253 | 12/1990 | Beal et al. | 126/512 |
| 5,069,200 | 12/1991 | Thow et al. | 126/512 |
| 5,281,130 | 1/1994 | LeBaigue | 431/125 |
| 5,320,520 | 6/1994 | Barth et al. | 431/125 |
| 5,392,763 | 2/1995 | Shaw et al. | 126/512 |
| 5,513,625 | 5/1996 | Landman | 126/243 |
| 5,743,249 | 4/1998 | Boekeloo et al. | 126/512 |
| 5,816,237 | 10/1998 | Fleming | 126/512 |
| 5,839,427 | 11/1998 | Shorts | 126/512 |
| 5,901,697 | 5/1999 | Oliver, Jr. et al. | 431/125 |
| 5,941,234 | 8/1999 | Norburn et al. | 126/146 |

FOREIGN PATENT DOCUMENTS

| | | | |
|---|---|---|---|
| 735212 | 5/1955 | United Kingdom | 126/512 |

*Primary Examiner*—Ira S. Lazarus
*Assistant Examiner*—David Lee
*Attorney, Agent, or Firm*—Coats & Bennett, PLLC

[57] ABSTRACT

The present invention entails a gas log set including a generally triangular shaped pan having front and rear portions and a pair of sides that extend generally rearwardly and inwardly from the front portion. Each side of the triangular shaped pan includes a cantilevered log support structure projecting outwardly therefrom for receiving and holding artificial logs. In addition, other artificial logs provided with the set are supported such that they extend into the pan itself.

39 Claims, 4 Drawing Sheets

GAS LOG SET

FIELD OF THE INVENTION

The present invention relates to artificial log sets, and more particularly, to gas log sets.

BACKGROUND OF THE INVENTION

It is not at all surprising that in the past 10 to 15 years, that artificial gas log sets have gained wide acceptance here in the United States and other parts of the world. As contrasted with conventional wood burning fireplaces, gas log sets are very convenient, clean and are efficient at delivering heat. While gas log sets have met with substantial success, over the years manufacturer's of gas log sets have continued to try to design and manufacture gas log sets that give the appearance and aesthetic qualities of conventional wood burning logs. There has been some success in this area. In fact, some gas log manufactures produce a line of gas log sets that are marketed and promoted as giving the look of real wood burning logs. But even with that success, there is still a need to improve the overall aesthetic qualities of artificial gas log sets.

It should also be pointed out that many of the artificial gas log sets that tend to be aesthetically pleasing are not very efficient in producing heat. Therefore, there has been and continues to be a need for improved aesthetics and a need for artificial logs that are designed to yield the look and feel of a conventional wood burning fireplace that will be more heat efficient.

SUMMARY OF THE INVENTION

The present invention entails an artificial gas log set that is designed to overcome the short comings and drawbacks of conventional gas logs that are marketed today. In particular, the gas log set of the present invention is designed to approach the appearance and feel that one gets from a conventional wood burning fireplace and at the same time provide high efficiency in directing heat from the artificial gas log set to adjoining areas.

The artificial gas log set of the present invention comprises a pan that may hold artificial ashes, with the pan being configured to receive and support one or more artificial logs. One or more of the artificial logs, in part at least, is actually contained or supported by the pan.

In one particular embodiment of the present invention, the pan assumes a generally triangular shape and includes front and rear portions and a pair of sides that extend generally rearwardly and inwardly from the front portion of the pan. Thus the pan is wider in the front than it is in the back. Formed on the sides is a log support structure that projects outwardly from the sides. These log support structures enable the pan to support one or more logs on the sides. Further, the pan is inclined upwardly towards the rear portion. Thus there is provided a support underneath the rear portion of the pan for elevating the rear portion above the front portion. In addition to the logs supported on the log supports projecting from the sides of the pan, other artificial logs can be supported within the pan. To generate the flame for the bas log set, there is provided a burner tube that is associated with the pan and by placing artificial ashes, rock wool, within the pan along with the logs supported by the pan, a flame is produced in and around the ashes and logs that resembles a wood burning fireplace.

Other objects and advantages of the present invention will become apparent and obvious from a study of the following description and the accompanying drawings which are merely illustrative of such invention.

DETAILED DESCRIPTION OF THE INVENTION

Figure 4:
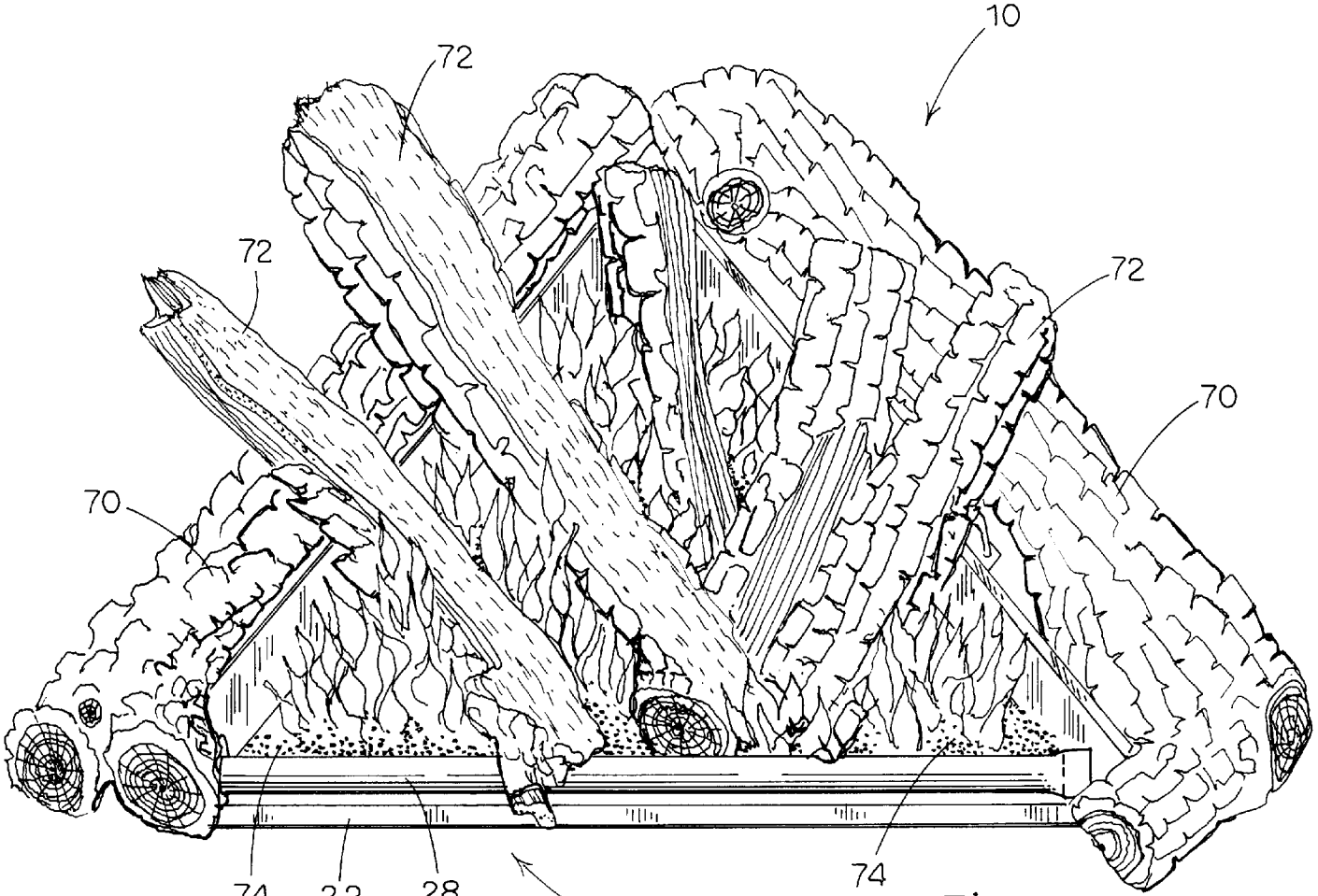
FIG. 4 is a perspective view of the artificial gas log set of the present invention illustrating artificial logs being supported on the pan along with a flame.

With further reference to the drawings, the artificial gas log set of the present invention is shown therein and indicated generally by the numeral 10. The gas log set 10 basically comprises a pan or log support indicated generally by the numeral 12 and an array of artificial logs indicated generally by the numeral 14. As will be appreciated from subsequent portions of this disclosure, the artificial logs 14 are supported by the pan 12 (FIG. 4).

Turning to a discussion of the pan 12, the pan in a preferred embodiment is constructed of metal and includes a bottom 20. In the embodiment disclosed herein, bottom 20 is of a generally triangular shape and includes a front lip 22 extending across the front portion of the pan. A pair of sides 24 extend upwardly from the bottom and extend generally from the front portion of the pan to a rear portion of the pan. Note that sides 24 generally extend rearwardly and inwardly from the front such that the pan retains a generally triangularly shaped configuration. The sides in the embodiment disclosed are solid, but it is appreciated that the sides may have holes provided therein or even may be formed by an open frame construction.

Figure 1:
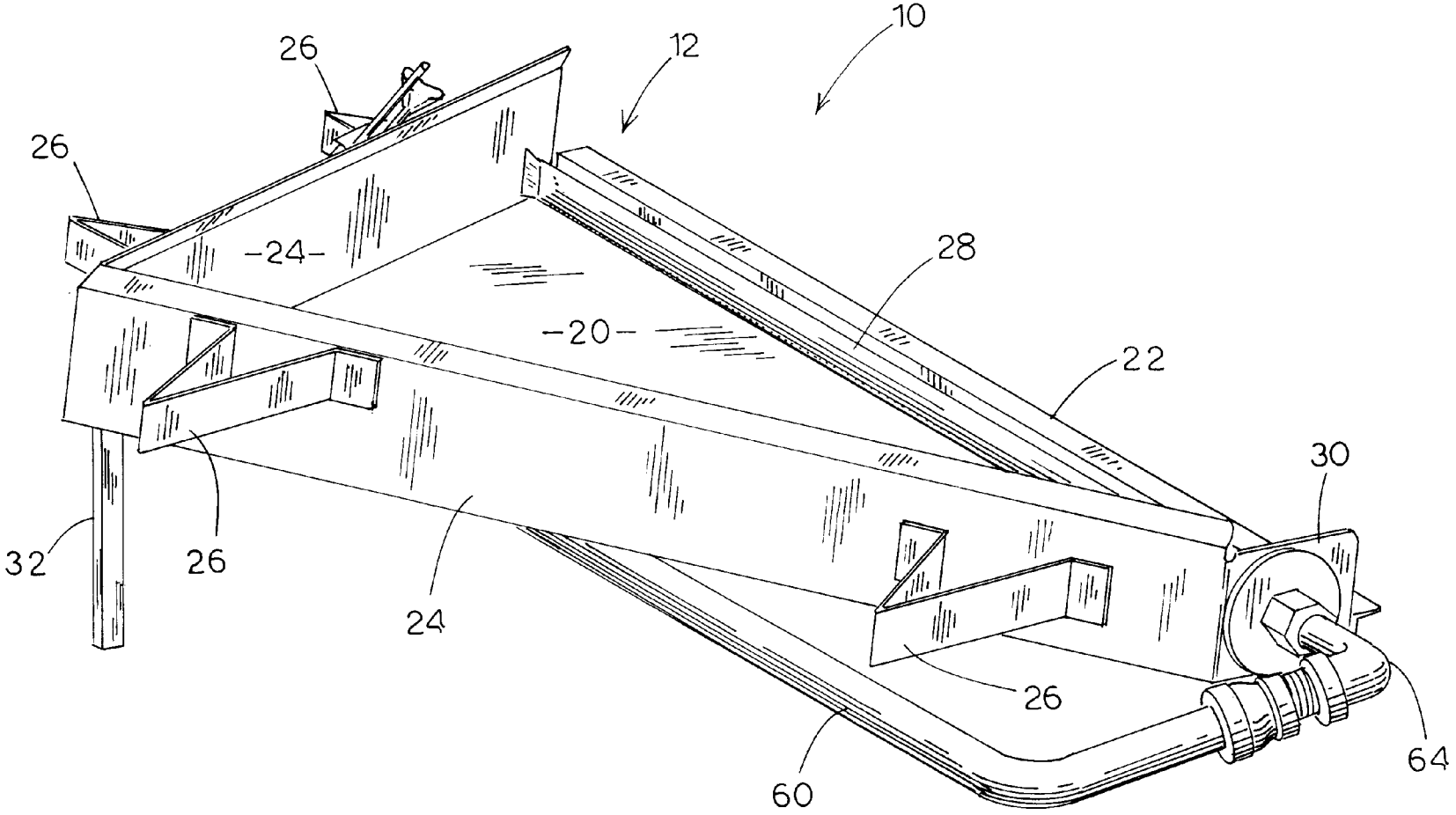
FIG. 1 is a perspective view of the pan of the artificial gas log set of the present invention.

Secured to the sides 24 are log support structures in the form of a series of cantilevered log supports 26. As illustrated in FIG. 1, the log supports 26 extend outwardly from the sides 24 of the pan 12. Each side is provided with a series of spaced apart log supports 26 that as will be described subsequently herein function to support an artificial log. Thus, it is appreciated that in the design shown in FIG. 1, that two artificial logs could be supported by the log supports 26, one log disposed adjacent each side 24.

Disposed across the front portion of the pan 12 is an elongated burner tube 28. Burner tube 28 includes a series of gas openings formed therein for disbursing gas into the pan. It is contemplated that the burner tube 28 would be oriented in the pan 12 such that its openings would be directed generally rearwardly in the pan. To retain the burner tube 28 in the pan 12, there is provided a retaining plate 30. Retaining plate 30 in this embodiment is simply an extension of the adjacent side 24 but is bent to properly align with the burner tube 28. On the opposite side, the burner tube 28 can be secured by different means and can even be attached or otherwise secured to the opposed side 24.

Figure 3:
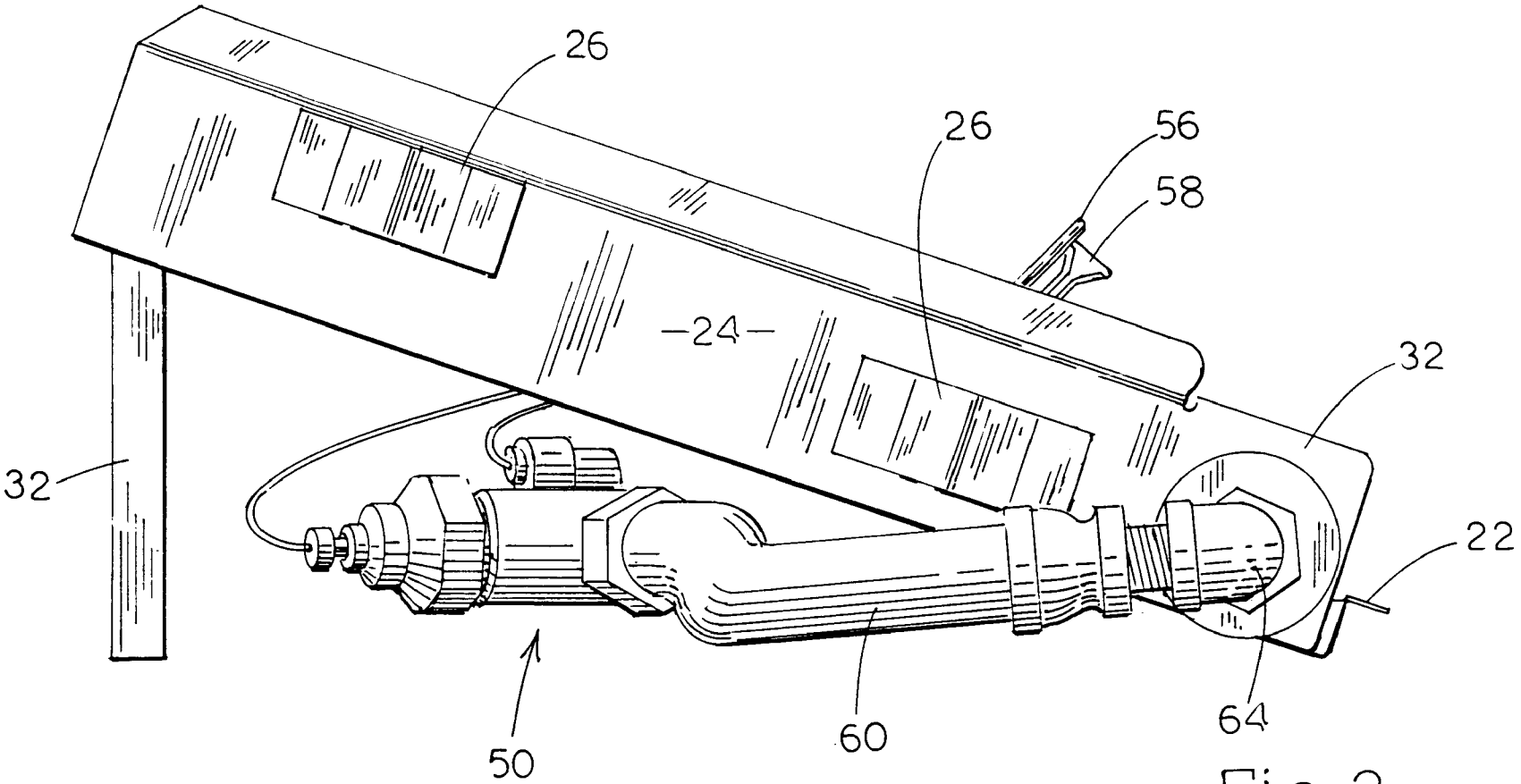
FIG. 3 is a side elevational view of the pan.

As pointed out above, the pan 12 includes a front portion and a rear portion. Because of the configuration of the pan 12, the front portion is wider than the rear portion. In addition, the rear portion is elevated with respect to the front portion. To achieve this elevation, there is provided a pan support 32 about the back portion of the pan that supports the pan such that the rear portion is elevated relative to the front portion. Note in FIG. 3 the basic orientation of the pan 12 as it is supported within a fireplace or on some other surface. The pan support 32 extends down and engages the support surface while the pan is supported at the front about the area of the bottom 20 just rearwardly of the front lip 22. In any event, as viewed in FIG. 3, one can note that the pan 12 is inclined generally upwardly from the front portion to the rear portion.

Figure 2:
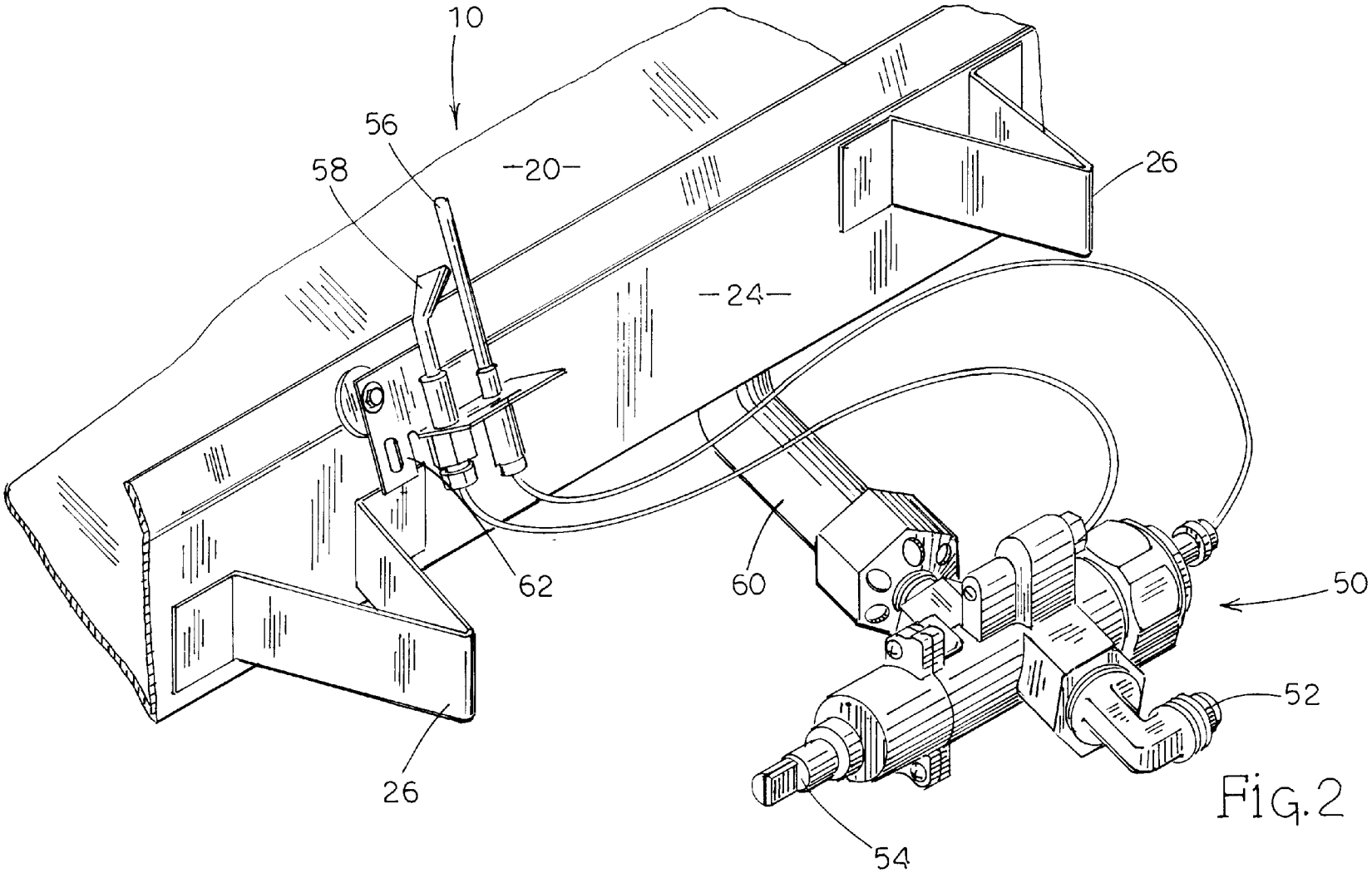
FIG. 2 is a fragmentary perspective view showing a portion of the pan along with the main control valve.

The gas log set further includes a main control valve 50 that is best seen in FIG. 2. The main control valve controls the flow of gas to the gas burner tube 28 and also controls the start-up and shut down of the gas log set 10. As seen in FIG. 2, the main control valve 50 includes a gas inlet 52 that is connected to a supply of gas. In addition, the control valve includes a manual control stem 54 that is used to turn the gas log set on and off and control the flow of gas to the burner tube 28. The stem 54 is adapted to be connected to a hand actuated extension crank or to a rotary dial. In addition, connected to the main control valve 50 is a thermocouple 56 and a pilot 58. The pilot 58 and thermocouple 56 are of a conventional design and are secured within a mounting bracket 62 that is in turn secured to the adjacent sides. A gas supply line 60 extends from the main control valve 50 and runs underneath the pan 12 to where it turns and extends forwardly at which point an elbow 64 interconnects the gas supply line 60 with a burner tube 28 through the retaining plate 30. Thus, due to the configuration and orientation of the pan 12, the main control valve 50 is generally hidden from view. In addition, because of the position of the main control 50 with respect to the pan 12, the control valve is generally maintained cooler.

Turning to FIG. 4, the gas log set 10 is shown therein with the pan 12 supporting a number of gas logs 70 and 72 and containing artificial ashes 74, which is commonly provided in the form of rock wool which would ordinarily be disposed over a thin layer of sand provided in the pan 12. In the case of pan 12, as disclosed herein, it is designed to accept and support two main logs indicated by the numeral 70 in FIG. 4. Note that each log 70 is supported on the pair of cantilevered log supports 26 that extend outwardly from a respective side. In addition, other logs, denoted by the numeral 72 are laid in the pan, in a general random configuration. As shown in FIG. 4, these additional artificial logs 72 can extend inwardly over the sides 24 of the pan 12. They can be appropriately spaced such that the flames from the ignition of the gas can be seen throughout the pan as the flames will tend to move up between the logs 72 disposed within the pan.

Therefore, it is appreciated that the gas log set 10 of the present invention offers many advantages over other commercially available gas log sets. The pan itself serves as a combination pan and grate structure as the pan actually supports one or more logs. In addition, because of the configuration of the pan 12 and the manner in which the pan can support a series of logs, one can see a substantial amount of flames moving up from the bottom 20 of the pan and between the logs 72 supported within the pan. This gives the fire and flame the appearance of wood logs burning in a fireplace. Further, the main logs supported on the sides 24 do not hide or interfere with the flame, thus those viewing the fire see substantially more flames which create a vibrant log burning image.

Further, the inclination of the pan 12 tends to orient the fire such that the gas log set 10 radiates heat outwardly from the fireplace into the adjoining room. Because of the shape of the pan, it has a tendency to fill the fireplace and create the appearance of a large log burning fire in the fireplace.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. An artificial gas log set comprising: an artificial log support in the form of a pan assuming a triangular shaped configuration and including a bottom and having front and rear portions with the front portion being wider than the rear portion and the rear portion being elevated relative to the front portion; and a series of artificial gas logs supported on the artificial log support.

2. The artificial gas logs of claim 1 wherein the artificial log support includes a pair of sides that project rearwardly and inwardly from the front portion.

3. The artificial gas log set of claim 2 wherein there is provided a cantilevered log support structure that projects from at least one side, the log support structure being adapted to receive and support at least one artificial log.

4. The artificial gas log set of claim 3 wherein the cantilevered log support structure projects outwardly from the side.

5. The artificial gas log set of claim 4 wherein the cantilevered log support structure includes at least two spaced apart supports that project outwardly from the side.

6. The artificial gas log set of claim 1 including at least one support connected to the rear portion of the log support for supporting the rear portion of the log support at a height above the front portion of the log support.

7. The artificial gas log set of claim 1 wherein the pan includes at least two sides.

8. The artificial gas log set of claim 7 including cantilevered log supports secured to the sides and projecting outwardly therefrom, whereby the cantilevered log supports act to support one or more artificial logs about the pan.

9. The artificial gas log set of claim 1 wherein the pan includes an open front and a pair of sides that extend rearwardly and inwardly from the front.

10. The artificial gas log set of claim 9 wherein the pan holds and supports a plurality of the artificial logs.

11. An artificial gas log set comprising:

a. a generally triangular shaped pan having a front portion and a rear portion and a pair of sides that extend generally rearwardly and inwardly from the front portion such that the front portion is wider than the back portion;

b. log supports projecting outwardly from each side;

c. a pan support for supporting the rear portion of the pan at an elevation above the front portion such that the pan is generally inclined upwardly and rearwardly from the front portion; and d. a series of artificial logs supported by the pan, and wherein one or more logs are held and supported by the log supports projecting from the sides and wherein one or more logs are supported such that portions thereof project into the pan.

12. The artificial gas log set of claim 11 wherein a burner tube extends across the front portion of the pan.

13. The gas log set of claim 12 including a gas line that passes underneath the pan and connects to an end of the burner tube, and wherein the gas line connects to a control valve that is disposed on a side of the pan opposite where the gas line connects to the burner tube.

14. The gas log set of claim 11 wherein the pan is adapted to hold artificial ashes.

15. The artificial gas log set of claim 11 wherein the pan is generally in the form of an equilateral triangle.

16. The artificial gas log set of claim 11 wherein the log supports include a series of spaced apart cantilevered supports that project outwardly from respective sides.

17. The artificial gas log set of claim 11 wherein the pan includes a bottom for holding artificial ashes and for supporting portions of one or more artificial logs.

18. An artificial gas log set comprising:

a. a pan for holding artificial ashes, said pan including a front portion and a back portion and wherein the back portion is elevated relative to the front portion;

b. the pan configured to receive and support one or more artificial logs by assuming a generally triangularly shaped configuration; and c. at least one artificial log supported by the pan such that the pan effectively forms a combination pan and grate.

19. The artificial gas log sets of claim 18 wherein the pan includes at least one log support that receives and supports the artificial log.

20. The artificial log set of claim 18 wherein the pan includes at least one side and a log support structure projecting from the one side.

21. The artificial log set of claim 20 wherein the pan includes at least two sides and a log support structure projecting from each side.

22. The artificial log set of claim 21 wherein the two sides form retainers around the triangularly shaped pan and wherein a third side of the pan remains open.

23. The artificial log set of claim 18 wherein the triangular configuration of the pan is such that one side of the pan forms the front of the pan while two other sides project rearwardly therefrom at an angle to the front to where they meet at the rear portion of the pan.

24. The artificial log set of claim 23 wherein the front side is open.

25. An artificial gas log set comprising:

a. a generally triangular shaped pan having a front portion and a rear portion and a pair of sides that extend generally rearwardly and inwardly from the front portion such that the front portion is wider than the rear portion;

b. a burner tube extending across the front portion of the pan;

c. log supports projecting outwardly from each side;

d. a pan support for supporting the rear portion of the pan at an elevation above the front portion such that the pan is generally inclined upwardly and rearwardly from the front portion; and e. a series of artificial logs supported by the pan, and wherein one or more logs are held and supported by the log supports projecting from the sides and wherein one or more logs are supported such that portions thereof project into the pan.

26. The gas log set of claim 25 including a gas line that passes underneath the pan and connects to an end of the burner tube, and wherein the gas lines connects to a control valve that is disposed on a side of the pan opposite where the gas line connects to the burner tube.

27. The artificial gas log set of claim 25 wherein the pan is adapted to hold artificial ashes.

28. The artificial gas log set of claim 25 wherein the pan is generally in the form of an equilateral triangle.

29. The artificial gas log set of claim 25 wherein the log supports include a series of spaced apart cantilevered supports that project outwardly from respective sides.

30. The artificial gas log set of claim 25 wherein the pan includes a closed bottom for holding artificial ashes and for supporting portions one or more artificial logs.

31. The artificial gas log set of claim 30 wherein the pan holds and supports both artificial ashes and one or more artificial logs.

32. An artificial gas log set comprising:

a. a generally triangular configured pan for holding ashes and including a front portion and a back portion with the back portion being elevated relative to the front portion, and wherein the generally triangular configuration of the pan is such that two sides of the pan project rearwardly at an angle to the front portion of the pan to where they meet at the rear portion of the pan;

b. the pan configured to receive and support one or more artificial logs; and c. at least one artificial log supported by the pan such that the pan effectively forms a combination pan and grate.

33. The artificial gas log set of claim 32 wherein the front portion of the pan is open.

34. The artificial gas log set of claim 32 wherein the pan includes at least one log support that receives and supports at least one artificial log.

35. The artificial gas lot set of claim 32 wherein at least one side of the pan includes a log support structure projecting therefrom for supporting at least one artificial log.

36. The artificial gas log set of claim 35 wherein both sides of the pan includes log supports projecting therefrom for supporting two or more artificial logs.

37. The artificial gas log set of claim 32 wherein the two sides of the pan form retainers around the generally triangularly shaped pan while the front portion remains open.

38. An artificial gas log set comprising: an artificial gas log support for supporting a series of artificial logs, the artificial gas log support including a supporting structure for supporting two artificial logs of the series in a generally inclined position such that each of the two artificial logs extends generally upwardly, inwardly and rearwardly to where upper end portions of each of the two logs terminate in relative close proximity to each other; and wherein the series of artificial logs includes one or more additional artificial logs that are supported in part at least, between the two inclined logs by the artificial gas log support, and further wherein the artificial gas log support includes a generally triangularly shaped pan including a front portion and a rear portion with the front portion being wider than the rear portion and wherein there is provided a support for elevating the rear portion above the front portion, and wherein the series of artificial logs are supported on the generally triangularly shaped pan.

39. The artificial gas log set of claim 38 wherein the pan includes a pair of sides, and wherein the two inclined artificial logs are supported adjacent the two sides while the one or more additional artificial logs of the series extend inwardly into the pan and are supported, in part at least, by the pan.

* * * * *